US007891782B2

(12) United States Patent
Owaki et al.

(10) Patent No.: US 7,891,782 B2
(45) Date of Patent: Feb. 22, 2011

(54) LIQUID INJECTING HEAD, METHOD OF MANUFACTURING LIQUID INJECTING HEAD, AND LIQUID INJECTING DEVICE

(75) Inventors: Hiroshige Owaki, Okaya (JP); Yoshinao Miyata, Matsukawa-Mura (JP); Toshiaki Kori, Suwa (JP); Satoshi Nakajima, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 165 days.

(21) Appl. No.: 12/405,913

(22) Filed: Mar. 17, 2009

(65) Prior Publication Data

US 2009/0237464 A1 Sep. 24, 2009

(30) Foreign Application Priority Data

Mar. 18, 2008 (JP) ..... 2008-069565
Mar. 18, 2008 (JP) ..... 2008-069566
Dec. 10, 2008 (JP) ..... 2008-315104
Dec. 10, 2008 (JP) ..... 2008-315105

(51) Int. Cl.
*B41J 2/045* (2006.01)
*B41J 2/05* (2006.01)

(52) U.S. Cl. ..... 347/68; 347/58

(58) Field of Classification Search ..... 347/68, 347/69–72, 50, 57, 58; 400/124.14, 124.16; 310/311, 324, 327, 365

See application file for complete search history.

(56) References Cited

U.S. PATENT DOCUMENTS 7,364,273 B2 * 4/2008 Takahashi ..... 347/68
2007/0070125 A1 * 3/2007 Watanabe ..... 347/58
2007/0182787 A1 * 8/2007 Kubo et al. ..... 347/58
2008/0239010 A1 * 10/2008 Tomita et al. ..... 347/58

FOREIGN PATENT DOCUMENTS

JP 2004-148813 5/2004

* cited by examiner

*Primary Examiner*—K. Feggins
(74) *Attorney, Agent, or Firm*—Workman Nydegger

(57) ABSTRACT

A liquid injecting head includes a flow path forming substrate in which a pressure generating chamber communicated with a nozzle opening that injects liquid is formed, a pressure generating element that is formed so as to apply pressure to the pressure generating chamber for injecting the liquid, a lead electrode that is connected to the pressure generating element, a wiring substrate having flexibility that is connected to the lead electrode, and a support member that is bonded to the wiring substrate. A fixing opening formed by perforating the wiring substrate in the thickness direction is disposed, and the wiring substrate and the support member are bonded together through an adhesive agent disposed inside the fixing opening.

17 Claims, 7 Drawing Sheets

LIQUID INJECTING HEAD, METHOD OF MANUFACTURING LIQUID INJECTING HEAD, AND LIQUID INJECTING DEVICE

The entire disclosure of Japanese Patent Applications Nos. 2008-069565 filed Mar. 18, 2008 and 2008-069566 filed Mar. 18, 2008 and 2008-315104 filed Dec. 10, 2008 and 2008-315105 filed Dec. 10, 2008 is expressly incorporated by reference herein.

BACKGROUND

1. Technical Field

The present invention relates to a liquid injecting head that injects liquid from a nozzle opening, a method of manufacturing the liquid injecting head, and a liquid injecting device, and more particularly, to an ink jet recording head that discharges ink as the liquid, a method of manufacturing the ink jet head, and an ink jet recording device.

2. Related Art

As a representative example of a liquid injecting head that discharges liquid droplets, there is an ink jet recording head that discharges ink droplets. As such ink jet recording head, for example, an ink jet recording head that includes a flow path forming substrate, in which a pressure generating chamber communicated with a nozzle opening and a communication part communicated with the pressure generating chamber are formed, a piezoelectric element that is formed on one face side of the flow path forming substrate, and a protection substrate that has a piezoelectric element holding part that is bonded to a piezoelectric element side of the flow path forming substrate and is used for holding the piezoelectric element has been known. Here, on the protection substrate, an IC that is a driving circuit used for driving the piezoelectric element is placed. In addition, the driving circuit and the piezoelectric element are connected through a lead electrode, which is led out from one electrode of the piezoelectric element, with a connection wiring that is formed of a conductive wire by using a wire bonding method.

As the protection substrate, there is a type that protects piezoelectric elements of two rows facing each other that are built in correspondence with pressure generating chambers of two rows. In the protection substrate of such a type, a through hole through which the connection wiring passes is formed on a center portion thereof. In such an ink jet recording head, the lead electrode and the connection wiring are connected in the through hole portion (for example, see JP-A-2004-148813).

However, in the above-described general technology, the driving circuit and the piezoelectric elements are connected by using the wire bonding method. Accordingly, there are problems that the manufacturing cost is increased, and high density cannot be easily implemented. In addition, since the driving circuit is built in the protection substrate two-dimensionally, an area of an actuator portion including the piezoelectric elements is increased. Accordingly, in this point, an increase in the manufacturing cost occurs.

In addition, these problems exist not only in an ink jet recording head that discharges ink but also a liquid injecting head that injects liquid other than the ink.

SUMMARY

An advantage of some aspects of the invention is that it provides a liquid injecting head, a method of manufacturing the liquid injecting head, and a liquid injecting device capable of reducing the cost and implementing high density in an easy manner.

According to a first aspect of the invention, there is provided a liquid injecting head including: a flow path forming substrate in which a pressure generating chamber communicated with a nozzle opening that injects liquid is formed; a pressure generating element that is formed so as to apply pressure to the pressure generating chamber for injecting the liquid; a lead electrode that is connected to the pressure generating element; a wiring substrate having flexibility that is connected to the lead electrode; and a support member that is bonded to the wiring substrate. A fixing opening formed by perforating the wiring substrate in the thickness direction is disposed, and the wiring substrate and the support member are bonded together through an adhesive agent disposed inside the fixing opening.

According to the above-described liquid injecting head, the wiring substrate and the lead electrode of the piezoelectric element are connected without using a bonding wire or the like, and accordingly, the manufacturing cost can be reduced in an easy manner. In addition, the wiring substrate has the lower end portion connected to the lead electrode and is bonded to a side face of the support member, and accordingly, high density can be implemented in an easy manner. In addition, by disposing a driving circuit on the wiring substrate, the driving circuit is bonded to a side face side of the support member through the wiring substrate. Accordingly, heat generated by the driving circuit can be dissipated well, and whereby a stable operation of the liquid injecting head can be achieved. In addition, by bonding the support member and the wiring substrate through the fixing opening that is disposed in the wiring substrate, the wiring substrate can be bonded to the plate-shaped member in a state in which the position of the wiring substrate is determined at high precision. Accordingly, occurrence of bad connection between the lead electrode and the wiring substrate can be prevented.

In the above-described liquid injecting head, a plurality of the fixing openings may be disposed at a regular distance in an area facing the support member toward an arrangement direction of the lead electrode.

In such a case, the position of the lower end portion side of the wiring substrate that is connected to the lead electrode can be determined at high precision.

In addition, in the above-described liquid injecting head, it may be configured that a row, in which the pressure generating element is arranged, is aligned to be built, the support member is disposed in the direction of the arrangement, the wiring substrate is bonded to both side faces of the support member, and the fixing openings of the wiring substrate are disposed in positions facing the both side faces of the support member.

In such a case, even when there is a plurality of rows of the pressure generating elements, high density as described above can be implemented, and the manufacturing cost can be reduced. In addition, by disposing the fixing opening on one of the wiring substrates, the wiring substrate can be bonded to the support member in a state in which relative positions of both the wiring substrates are determined at high precision.

In addition, the above-described liquid injecting head, the adhesive agent that bonds the wiring substrate and the support member may be formed of an ultraviolet curing-type adhesive agent.

In such a case, a time required for curing the adhesive agent that bonds the wiring substrate and the support member can be shortened further, and the precision of determination of the position of the wiring substrate can be improved.

The above-described liquid injecting head may further include a holding member that is bonded to the support member through an adhesive agent.

In such a case, by bonding the holding member and the support member together, rigid bodies are bonded. Accordingly, as the support member and the wiring substrate are held by the holding member assuredly, and thereby occurrence of bad connection between the wiring substrate and the lead electrode can be prevented.

In addition, in the above-described liquid injecting head, the support member may be formed of a conductive material, and the support member is grounded.

In such a case, by grounding the support member, noise of the wiring substrate, particularly, the noise of the driving circuit at a time when the driving circuit is disposed in the wiring substrate can be suppressed. In addition, the noise generated at a time when a conduction member that is not grounded moves is reduced, and whereby influence of the noise on a driving signal for driving the pressure generating element or the like can be suppressed.

In addition, in the above-described liquid injecting head, it may be configured that the support member and the holding member are formed of conductive materials, the adhesive agent that bonds the support member and the holding member is formed of a conductive adhesive agent, and the support member and the holding member are in a conductive state through the conductive adhesive agent.

In such a case, the support member and the holding member can be in a conductive state in an easy manner. In addition, when any one between the support member and the holding member is grounded, both the support member and the holding member can be grounded. Accordingly, noise of the wiring substrate, particularly, the noise of the driving circuit at a time when the driving circuit is disposed in the wiring substrate can be suppressed. In addition, the noise generated at a time when a conduction member that is not grounded moves is reduced, and whereby influence of the noise on a driving signal for driving the pressure generating element or the like can be suppressed.

In addition, in the above-described liquid injecting head, the support member and the holding member may be formed of materials having equivalent linear expansion coefficients.

In such a case, when expansion or contraction due to heat occurs, a bending state caused by a difference of linear expansion coefficients or destruction such as generation of a crack due to pressing on the flow path forming substrate can be prevented assuredly.

In addition, in the above-described liquid injecting head, a holding opening formed by perforating the wiring substrate in the thickness direction may be disposed, and the support member and the holding member may be bonded through the holding opening by using the adhesive agent.

In such a case, the holding member and the support member can be bonded together through the holding opening in an easy manner.

In addition, in the above-described liquid injecting head, the holding opening that bonds the support member and the holding member may be disposed in the wiring substrate and be the fixing opening that bonds the wiring member and the support member.

In such a case, the fixing hole and the holding hole are commonly used, and the effective area of the wiring substrate is increased. Accordingly, a wiring process can be performed in an easy manner.

In addition, in the above-described liquid injecting head, the support member and the holding member may be bonded in a plurality of positions.

In such a case, by bonding the support member and the holding member in a plurality of positions, the support member can be held by the holding member more assuredly.

In addition, in the above-described liquid injecting head, a wiring member holding hole, through which the support member and the wiring substrate pass, formed by perforating the holding member in the thickness direction may be disposed, and an inner face of the wiring member holding hole and the support member may be bonded through an adhesive agent.

In such a case, the support member can be held by the holding member more assuredly.

In addition, in the above-described liquid injecting head, the wiring substrate and the lead electrode may be electrically connected with conductive particles.

In such a case, by only pressing the conductive particles to be smashed from the upper side, electrical connection can be implemented in an easy manner.

In addition, in the above-described liquid injecting head, a buffer member may be disposed in a lower end face of the support member.

In such a case, the conductive particles can be pressed uniformly, and accordingly, a plurality of the conductive particles corresponding to each lead terminal can be smashed uniform.

According to a second aspect of the invention, there is provided a liquid injecting device including the above-described liquid injecting head.

According to the above-described liquid injecting device, as a liquid injecting device, the above-described individual advantages can be acquired.

The above-described liquid injecting device may further include a ground part that grounds the support member.

In such a case, by grounding the support member, the noise generated from the driving circuit or the like can be shielded, and accordingly, disturbance of the noise on the driving signal or the like can be suppressed. In addition, by grounding the support member, generation of noise due to floating metal that remains at the time of movement of the liquid injecting head or the like can be reduced.

According to a third aspect of the invention, there is provided a method of manufacturing a liquid injecting head that includes: a flow path forming substrate in which a pressure generating chamber communicated with a nozzle opening that injects liquid is formed; a pressure generating element that is formed so as to apply pressure to the pressure generating chamber for injecting the liquid; a lead electrode that is connected to the pressure generating element; a wiring substrate having flexibility that is connected to the lead electrode; and a support member that is bonded to the wiring substrate. A fixing opening, which is formed by perforating the wiring substrate in the thickness direction, is disposed on at least a side face of the wiring substrate that is located on the lower end part side. The method includes: bonding the wiring substrate on one side of the support member; disposing the wiring substrate on the other side of the support member so as to determine a position of one side of the wiring substrate with respect to the other side of the wiring substrate; and bonding the wiring substrate and the support member by using an adhesive agent of the fixing opening that is formed in the wiring substrate that is disposed on the other side of the support member.

According to the above-described method, the other wiring substrate can be bonded to the support member through the fixing opening in a state in which the position of the other wiring substrate is determined at high precision. Accordingly, the lead electrode and the wiring substrate can be connected at high precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

Embodiment 1

Figure 1:
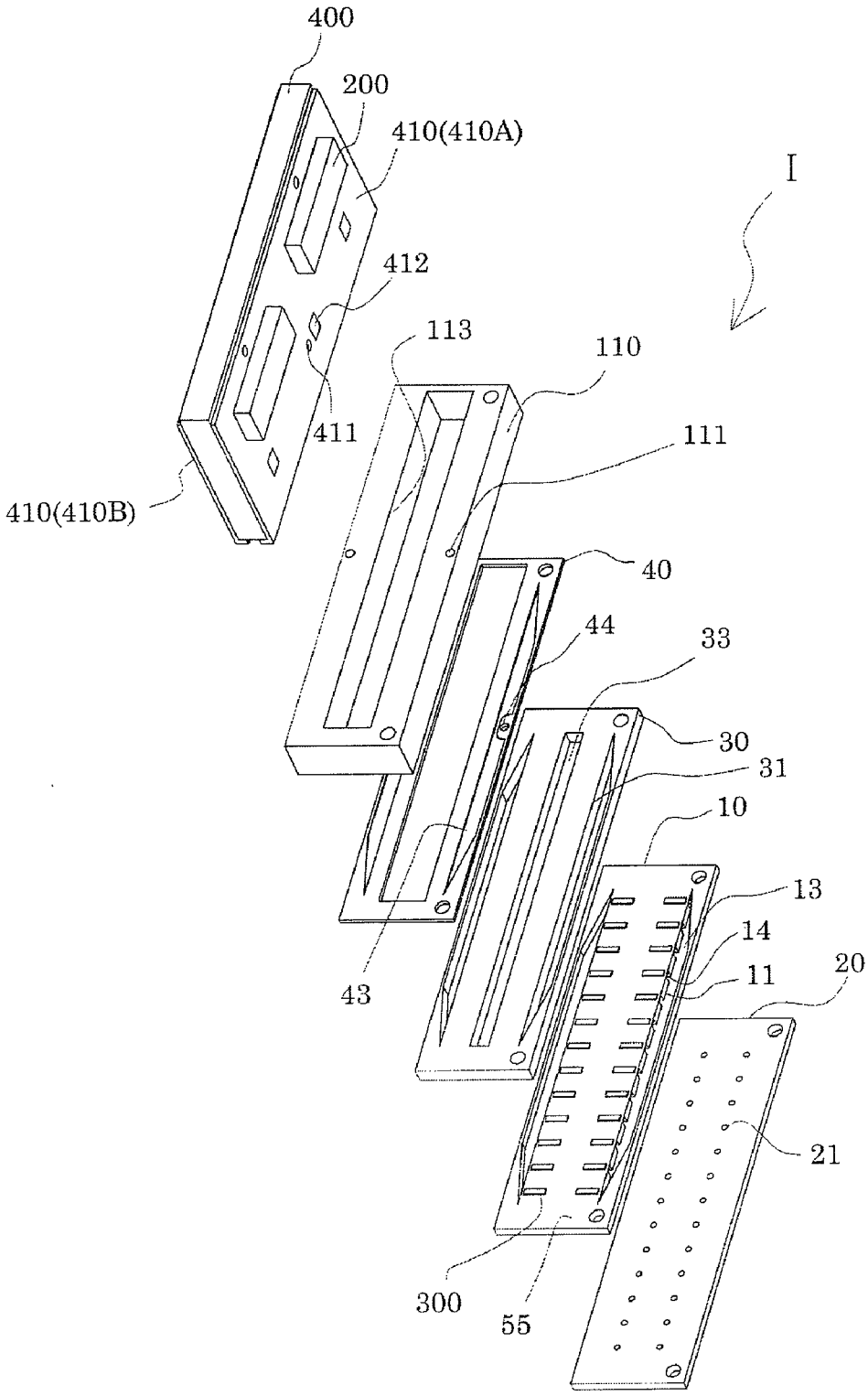
FIG. 1 is an exploded perspective view of a record head according to Embodiment 1 of the invention.
Figure 2:
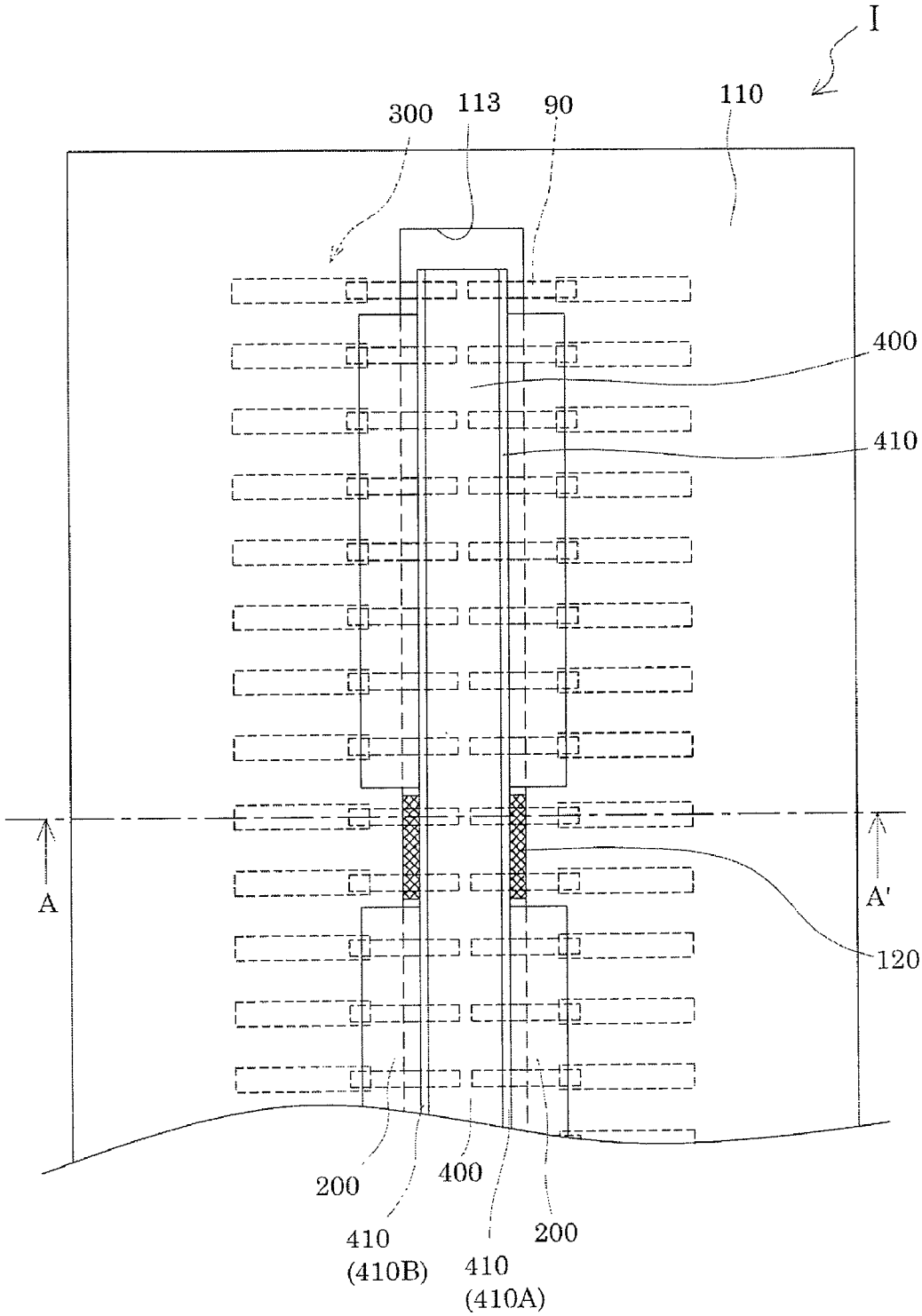
FIG. 2 is a plan view of the record head according to Embodiment 1.
Figure 3:
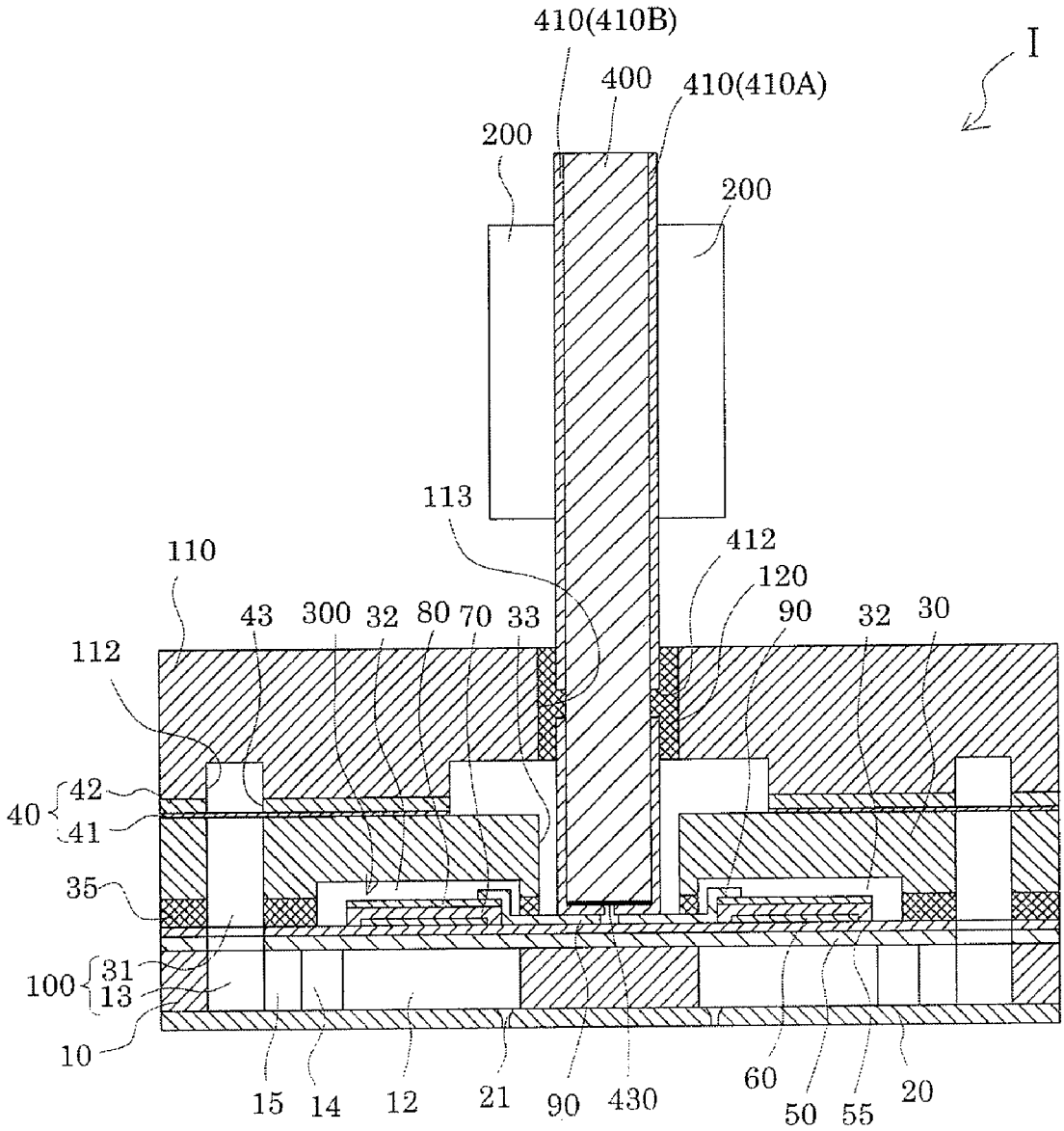
FIG. 3 is a cross-section view of the record head according to Embodiment 1.
Figure 4A:
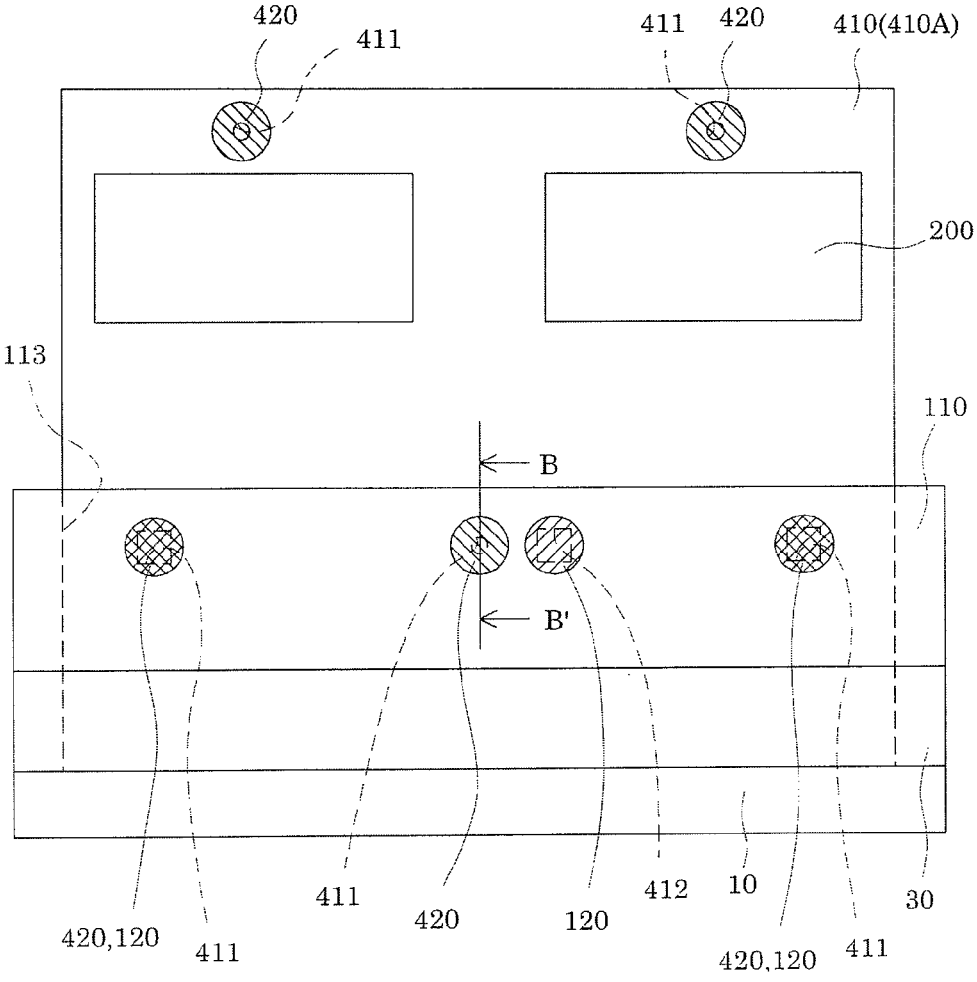
FIGS. 4A and 4B are a side view and a cross-section view of the record head according to Embodiment 1.
Figure 4B:
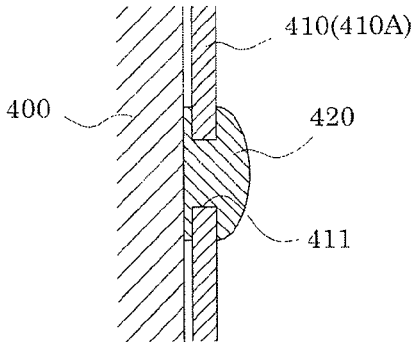

FIG. 1 is a schematic exploded perspective view of an ink jet recording head as an example of a liquid injecting head according to Embodiment 1 of the invention. FIG. 2 is a plan view of FIG. 1. FIG. 3 is a cross-section view of FIG. 2 taken along line III-III. FIG. 4A is a side view of FIG. 1 and FIG. 4B is a cross-section view taken along the line IVB-IVB of FIG. 4A.

As shown in the figure, a flow path forming substrate 10, according to this embodiment, is formed of a single-crystal silicon substrate of a plane orientation (110). On one side of the flow path forming substrate 10, an elastic film 50, which is formed of silicon dioxide, is formed. The flow path forming substrate 10 may be formed of a material other than the single-crystal silicon substrate, for example, a metal plate or a ceramic plate.

In the flow path forming substrate 10, two rows, in which a plurality of pressure generating chambers 12 partitioned by a partition wall 11 is arranged in the widthwise direction thereof, are disposed. In addition, in an outer area of the pressure generating chambers 12 of each row in the longitudinal direction, a communication part 13 is formed. The communication part 13 and the pressure generating chambers 12 are communicated with each other through an ink supplying path 14 and a communication path 15 that are disposed for each pressure generating chamber 12. The communication part 13 is communicated with a reservoir part 31 of a protection substrate 20 to be described later. The communication part 13 configures a part of a reservoir 100 that becomes a common ink chamber for each row of the pressure generating chambers 12. The ink supplying path 14 is formed to have a width narrower than that of the pressure generating chamber 12 and maintains flow path resistance of ink flowing into the pressure generating chamber 12 from the communication part 13 to be constant. In addition, according to this embodiment, the ink supplying path 14 is formed by constricting the width of the flow path from one side. However, the ink supplying path may be formed by contracting the width of the flow path from both sides. In addition, the ink supplying path may be formed by constricting the flow path in the thickness direction, instead of constricting the flow path in widthwise direction. In addition, each communication path 15 is formed by partitioning a space between the ink supplying path 14 and the communication part 13 by extending the partition walls 11 located on both sides of the pressure generating chambers 12 in the widthwise direction to the communication part 13 sides. In other words, in the flow path forming substrate 10, the ink supplying path 14 having a cross-sectional area smaller than that of the pressure generating chamber 12 in the widthwise direction and the communication path 15 that is communicated with the ink supplying path 14 and has a cross-sectional area larger than that of the ink supplying path 14 in the widthwise direction are disposed by being partitioned by a plurality of the partition walls 11.

In addition, on the opening face side of the flow path forming substrate 10, a nozzle plate 20, in which nozzle openings 21 that are communicated with areas near end portions of the pressure generating chambers 12 that are located on a side opposite to the ink supplying path 14 are is formed, is fixed by using an adhesive agent, a heat-welding film, or the like. In this embodiment, two rows in which the pressure generating chambers 12 are arranged are disposed on the flow path forming substrate 10. Accordingly, in one ink jet recording head I, two nozzle rows in which the nozzle openings 21 are arranged are disposed. The nozzle plate 20, for example, is formed of glass ceramics, a single-crystal silicon substrate, or stainless steel.

On the other hand, on a side of the flow path forming substrate 10 that is located opposite to the opening face, as described above, the elastic film 50 is formed. In addition, an insulation film 55 is formed on the elastic film 50. In addition, on the insulation film 55, a lower electrode film 60, a piezoelectric body layer 70, and an upper electrode film 80 are laminated to be formed so as to configure a piezoelectric element 300 that is a pressure generating element according to this embodiment. Here, the piezoelectric element 300 represents a part that includes the lower electrode film 60, the piezoelectric body layer 70, and the upper electrode film 80. Generally, any one electrode of the piezoelectric element 300 is used as a common electrode, and the other electrode and the piezoelectric body layer 70 are patterned for each pressure generating chamber 12. Here, a part that is configured by the patterned electrode and the patterned piezoelectric body layer 70 and has piezoelectric distortion by applying a voltage to both electrodes is called as a piezoelectric body active part. In this embodiment, the lower electrode film 60 is configured as the common electrode of the piezoelectric element 300, and the upper electrode 80 is configured as an individual electrode of the piezoelectric element 300. However, these may be oppositely configured depending on the situation of the driving circuit and wirings. In addition, here, the piezoelectric element 300 and a vibration plate that is displaced in accordance with driving of the piezoelectric element 300 are collectively referred to as an actuator device. In addition, in the above-described example, the elastic film 50, the insulation film 55, and the lower electrode film 60 serve as a vibration plate. However, the invention is not limited thereto. For example, a configuration in which only the lower electrode film 80 serves as a vibration plate without disposing the elastic film 50 and the insulation film 55 may be used. Alternatively, the piezoelectric element 300 may be configured so as to substantially serve as the vibration plate as well.

The piezoelectric body layer 70 is formed of a piezoelectric material, which exhibits electromechanical energy converting reaction occurring on the lower electrode film 60, and more particularly, a ferroelectric material, which has a perovskite structure, among piezoelectric materials. It is preferable that a crystal film having a perovskite structure is used for the piezoelectric body layer 70. For example, a ferroelectric material such as lead zirconium titanate (PZT), or the ferroelectric material to which metal oxide such as niobe oxide, nickel oxide, or magnesium oxide is added may be appropriately used for the piezoelectric body layer 70. In particular, lead titanate ($PbTiO_3$), lead zirconium titanate ($Pb(Zr, Ti)O_3$), lead zirconate ($PbZrO_3$), lead lanthanum titanate ($(Pb, La), TiO_3$) lead lanthanum titanate-zirconate ($(Pb, La)(Zr, Ti)O_3$) lead magnesium niobate zirconium titanate ($Pb(Zr, Ti)(Mg, Nb)O_3$), or the like may be used. The thickness of the piezoelectric body layer 70 is suppressed such that any crack is not generated in the manufacturing process and is formed such that the thickness is enough to exhibit a sufficient displacement characteristic.

In addition, to the upper electrode film 80 that is an individual electrode of the piezoelectric element 300, a lead electrode 90 that extends to an area located on the insulation film 55 and is, for example, formed of gold (Au) is connected. One end portion of the lead electrode 90 is connected to the upper electrode film 80, and the other end portion of the lead electrode 90 extends to be installed between the rows in which the piezoelectric elements 300 are arranged.

On the flow path forming substrate 10, in which the piezoelectric elements 300 are formed, that is, on the lower electrode film 60, the elastic film 50, and the lead electrode 90, the protection substrate 30 having the reservoir part 31 that configures at least a part of the reservoir 100 is bonded through an adhesive agent 35. This reservoir part 31, according to this embodiment, is formed to extend in the widthwise direction of the pressure generating chamber 12 by perforating the protection substrate 30 in the thickness direction. Thus, as described above, the reservoir part 31 is communicated with the communication part 13 of the flow path forming substrate 10 and configures the reservoir 100 that becomes the common ink chamber of the pressure generating chambers 12. In addition, in this embodiment, the communication part 13 that becomes the reservoir 100 is disposed on the flow path forming substrate 10. However, the invention is not particularly limited thereto. For example, the communication part 13 of the flow path forming substrate 10 may be divided into a plurality of parts for each pressure generating chamber 12, and only the reservoir part 31 may be configured as the reservoir. Alternatively, for example, only the pressure generating chamber 12 is disposed on the flow path forming substrate 10, and an ink supplying path 14 that allows the reservoir and each pressure generating chamber 12 to be communicated with each other may be disposed in a member (for example, the elastic film 50, the insulation film 55, or the like) that is interposed between the flow path forming substrate 10 and the protection substrate 30.

In addition, in each area of the protection substrate 30 that faces the piezoelectric elements 300, a piezoelectric element holding part 32 that is a holding part having a space sufficient for not blocking movement of the piezoelectric elements 300 is disposed. The piezoelectric element holding part 32 is configured to have a space sufficient for not blocking movement of the piezoelectric elements 300. The space may be sealed or may not be sealed. In addition, according to this embodiment, two rows in which the piezoelectric elements 300 are arranged are disposed, and accordingly, the piezoelectric element holding parts 32 are disposed in correspondence with each arranged row in which the piezoelectric elements 300 are arranged. In other words, in the protection substrate 30, two piezoelectric element holding parts 32 are disposed in the arrangement direction of the rows in which the piezoelectric elements 300 are arranged.

As the protection substrate 30, it is preferable that a material such as a glass material or a ceramic material that has an approximately same coefficient of thermal expansion as that of the flow path forming substrate 10 is used. In this embodiment, a single-crystal silicon substrate that is the same as the material of the flow path forming substrate 10 is used for forming the protection substrate 30.

In addition, in the protection substrate 30, a through hole 33 that is formed by perforating the protection substrate 30 in the thickness direction is disposed. The through hole 33, in this embodiment, is disposed between two piezoelectric element holding parts 32. In addition, a portion of the lead electrode 90 near an end thereof that is led out from each piezoelectric element 300 is disposed so as to be exposed inside the communication hole 33.

As one type of a wiring substrate having flexibility, a COF substrate 410 that is a printed substrate is used, and the driving circuit 200 that is used for driving the piezoelectric element 300 is mounted on the COF substrate 410. Here, the COF substrate 410 has a lower end portion connected to the lead electrode 90 and can be set approximately vertically. Thus, the COF substrate 410 is bonded to the side face of a plate-shaped member 400 that is a support member. In other words, the plate-shaped member 400 as a support member of this embodiment is a rectangular parallelepiped having both side faces to be vertical faces. According to this embodiment, the wiring substrate is configured by the plate-shaped member 400, the COF substrate 410, and the driving circuit 200.

Described in more details, in the ink jet recording head I according to this embodiment, two rows in which the pressure generating chambers 12 are arranged are disposed in the flow path forming substrate 10, and accordingly, two rows in which the piezoelectric elements 300 are arranged in the widthwise direction of the pressure generating chamber 12 (the widthwise direction of the piezoelectric element 300) are disposed. In other words, two rows of the pressure generating chambers 12, two rows of the piezoelectric elements 300, and two rows of the lead electrodes 90 are disposed to face one another. To both sides of the plate-shaped member 400 having a lower portion inserted into the through hole 33, the COF substrates 410 are bonded. Thus, each COF substrates 410 has a lower portion connected to the end portions of the lead electrodes 90 of each row of the piezoelectric elements 300 and can be set approximately vertically. According to this embodiment, by disposing one COF substrate 410 on each side face of the plate-shaped member 400, a total of two COF substrates 410 are disposed in one plate-shaped member 400.

In addition, when being erected as a single body, the COF substrate 410 that is a printed substrate having flexibility is bent. Accordingly, by bonding the COF substrate 410 to the plate-shaped member 400 that is a rigid member, the COF substrate 410 can be erected by suppressing bending thereof.

In addition, in this embodiment, the plate-shaped member 400 having a rectangular parallelepiped shape is used. However, a support member having various shapes such as a lattice shape and a raft shape may be used as long as it can support the wiring substrate to erect.

Here, in the COF substrate 410A that is disposed on one side face of the plate-shaped member 400, as shown in FIGS. 4A and 4B, in areas facing the lower end portion side of a side face of the plate-shaped member 400 (a side connected to the lead electrode 90), a plurality of fixing openings 411 is disposed toward the arrangement direction of the lead electrode 90 at a predetermined distance. In this embodiment, three fixing openings 411 are disposed on the lower end portion side of the COF substrate 410 so as to have an equal distance therebetween in the arrangement direction of the lead electrode 90, and two fixing openings 411 are disposed on the upper end portion side thereof.

In addition, the plate-shaped member 400 and the COF substrate 410A that is disposed on one side face of the plate-shaped member 400 are bonded through an adhesive agent 420 disposed inside the fixing opening 411. In this embodiment, the adhesive agent 420 fills inside the fixing opening 411 and is disposed so as to cover the opening of the fixing opening 411. In addition, the adhesive agent 420 fills between the COF substrate 410A and the plate-shaped member 400 in the peripheral portion of the fixing opening 411. The COF substrate 410A and the plate-shaped member 400 are not bonded in a portion other than the adhesive agent 420 that is disposed in the fixing opening 411. In addition, in this embodiment, the entire face of the rear face of the COF substrate 410B that is disposed on the other side face of the plate-shaped member 400 is bonded to the plate-shaped member 400 by the adhesive agent 420.

It is preferable that an adhesive agent of which curing time is relatively short, for example, a ultraviolet-curable adhesive agent or an instant adhesive agent, or the like is used as the adhesive agent 420 that bonds the COF substrate 410A and the plate-shaped member 400.

Figure 5A:
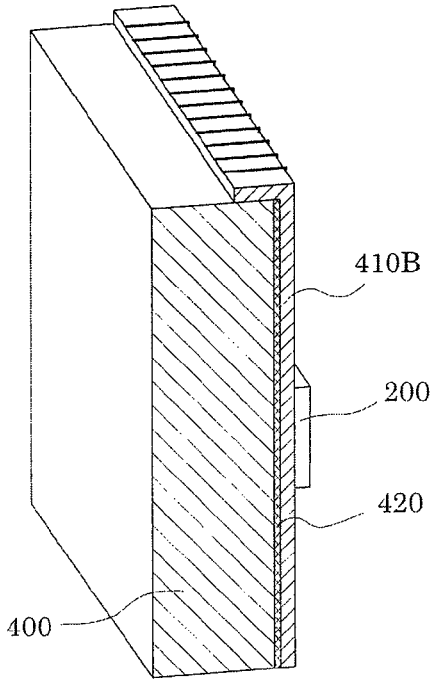
FIGS. 5A, 5B are perspective cross-section views showing a method of manufacturing the record head according to Embodiment 1.
Figure 5B:
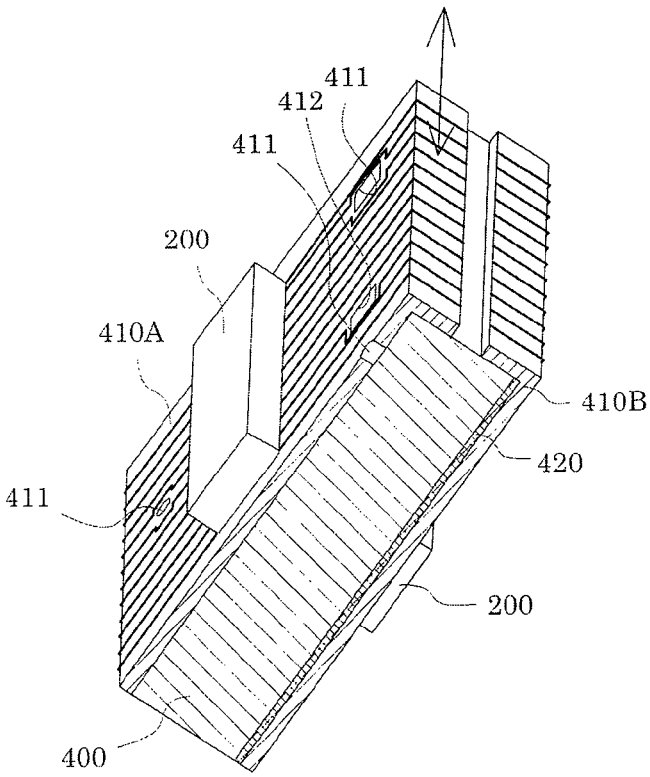
Figure 6:
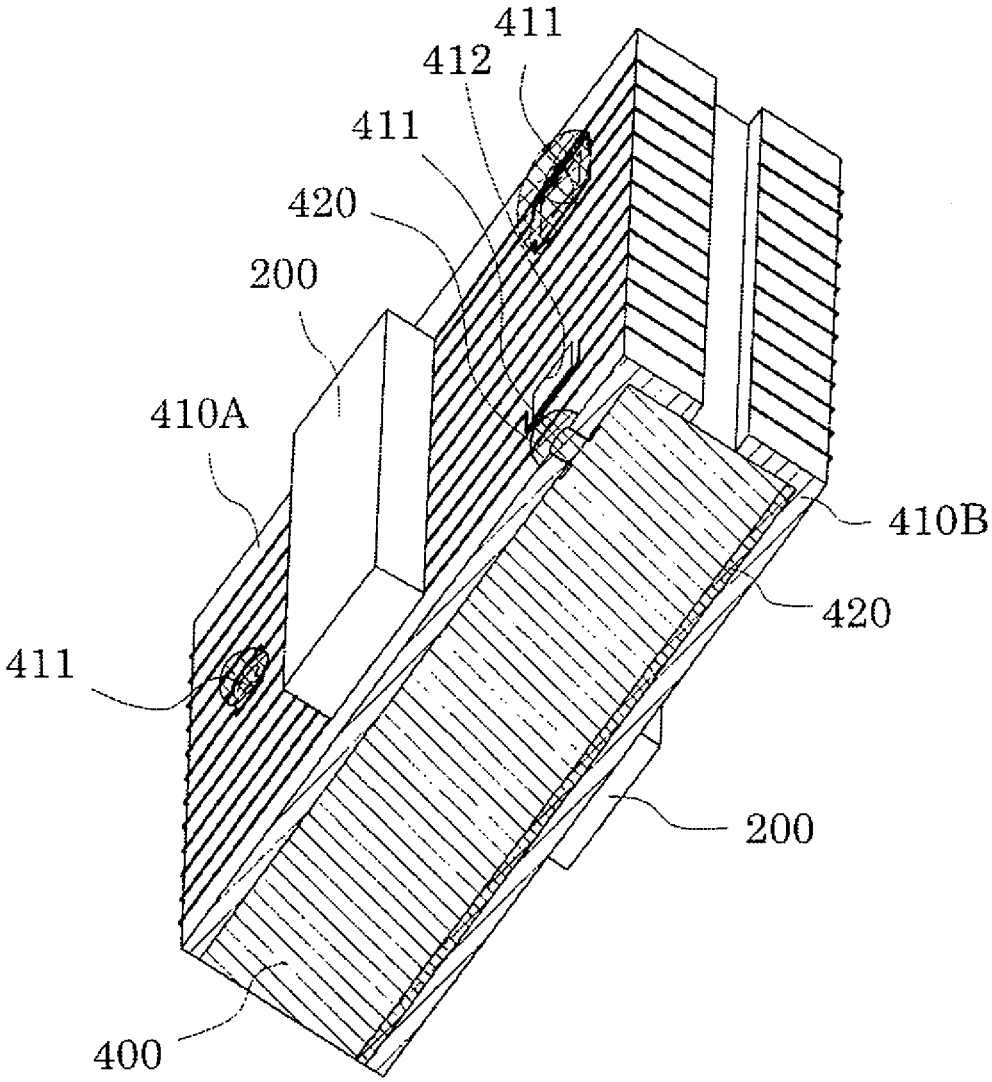
FIG. 6 is a perspective cross-section view showing a method of manufacturing the record head according to Embodiment 1.

Here, a method of manufacturing an ink jet recording head according to this embodiment, and more particularly, to a method of bonding the plate-shaped member 400 and the COF substrate 410 together will be described. FIGS. 5A, 5B, and 6 are perspective cross-section views showing a method of manufacturing the ink jet recording head.

First, as shown in FIG. 5A, the COF substrate 410B is bonded to one side of the side face of the plate-shaped member 400. The method of bonding the plate-shaped member 400 and the COF substrate 410B is not particularly limited. In this embodiment, the entire face of the rear face of the COF substrate 410B is bonded to the plate-shaped member 400 by using the adhesive agent 420.

Next, as shown in FIG. 5B, the plate-shaped member 400 is tilted such that the other side of the plate-shaped member 400 that is opposite to the face to which the COF substrate 410B is bonded is located on the upper side in the vertical direction of the plate-shaped member 400, and the COF substrate 410A is placed on the side face that is located on the upper side in the vertical direction. At this moment, the COF substrate 410A that is placed on the plate-shaped member 400 is maintained to be on the plate-shaped member 400 due to its weight. In addition, the COF substrate 410B that is disposed on the other side face of the plate-shaped member 400 is bonded to the plate-shaped member 400 so as not to fall down. In addition, the COF substrate 410A of which the lower end portion connected to the lead electrode 90 is bent in advance is used. The reason is as follows. When the lower end portion of the COF substrate 410A is bent along the plate-shaped member 400 after the COF substrate 410A is bonded to the plate-shaped member 400, it is difficult to determine the positions of the COF substrates 410A and 410B, and there is a high possibility that the position of the COF substrate 410A is deviated due to bending.

Then, the position of the COF substrate 410A is determined. In particular, the COF substrate 410A is moved in the direction, which becomes the arrangement direction of the lead electrode 90, with respect to the COF substrate 410B that is firstly bonded to the plate-shaped member 400, and relative positions of the COF substrates 410A and 410B are determined. Accordingly, the position of a wiring connected to the lead electrode 90 of one COF substrate 410B that is bonded first and the position of a wiring connected to the lead electrode 90 of the other COF substrate 410A in the arrangement direction can be determined.

Next, as shown in FIG. 6, by coating the fixing opening 411 of the COF substrate 410A with the adhesive agent 420 from the surface side in a state in which the position of the COF substrate 410A is determined, the adhesive agent 420 fills between the COF substrate 410A and the plate-shaped member 400 on the inside of the fixing opening 411 and the peripheral portion of the fixing opening 411. Then, by curing the adhesive agent 420, the COF substrate 410A and the plate-shaped member 400 are bonded together.

As described above, by bonding the COF substrate 410A and the plate-shaped member 400 through the fixing opening 411, two COF substrates 410A and 410B can be bonded in a state in which the relative positions thereof are determined with high precision. Thus, when the wirings of the lower end portions of two COF substrates 410A and 410B are connected to the lead electrode 90, bad connection due to positional deviations of the COF substrates 410A and 410B and the lead electrode 90 can be prevented. In addition, when the position of the COF substrate 410A is to be determined in a state in which the COF substrate 410A is brought into contact with the plate-shaped member 400 by coating the entire face of the rear face of the COF substrate 410A with the adhesive agent 420, it is difficult to move the COF substrate 410A due to viscosity of the adhesive agent 420, and thereby the position cannot be determined with high precision. In addition, when the entire face of the rear face of the COF substrate 410A is bonded to the plate-shaped member 400 by using the adhesive agent 420, a time required for curing the adhesive agent 420 is lengthened, and whereby the manufacturing efficiency is decreased. According to this embodiment, the COF substrate 410A and the plate-shaped member 400 are partially bonded through the adhesive agent 420 in an area in which the fixing opening 411 is disposed in a state in which the position of the COF substrate 410A is determined. Therefore, the COF substrate 410A can be bonded in an easy manner in a state in which the position of the COF substrate 410A is determined at high precision without causing any positional deviation. In addition, the COF substrate 410A is bonded to the plate-shaped member 400 by using the fixing opening 411 only, the bonding area is decreased, and a time required for curing the adhesive agent 420 can be shortened. Accordingly, the positional deviation of the COF substrate 410A in the middle of the curing process of the adhesive agent 420 can be prevented. Therefore, a decrease in the precision of position determining can be prevented, and the manufacturing efficiency can be improved. In addition, by using an adhesive agent that has a relatively short curing time as the adhesive agent 420, for example, an ultraviolet-curable adhesive agent, an instant adhesive agent, or the like, the time required for curing can be shortened further. Accordingly, the precision of position determining can be improved.

In addition, by disposing the fixing opening 411 on the lower end portion side, which is connected to the lead electrode 90 side, of the COF substrate 410A, particularly, determination of the position of the lower end portion of the COF substrate 410A that requires high precision can be performed with high precision. In other words, three fixing openings 411 that are disposed on the lower end portion of the COF substrate 410A are used for preventing the positional deviations of areas of the COF substrate 410A to which the lead electrode 90 is connected. Accordingly, it is preferable that the above-described three fixing openings 411 are disposed near an area to which the lead electrode 90 is connected. In addition, it is preferable that a plurality of the fixing openings 411 is disposed at a predetermined distance in the arrangement direction of the lead electrode 90. In addition, two fixing openings 411 that are disposed on the upper end portion of the COF substrate 410A are used for preventing the upper end portion side of the COF substrate 410A from being peeled off from the plate-shaped member 400. Accordingly, the positions and the number of the fixing openings 411 are not particularly limited.

In addition, in the above-described example, the entire face of the rear face of the COF substrate 410B is configured to be bonded to the plate-shaped member 400. However, the invention is not limited thereto. For example, it may be configured that a fixing opening 411 is disposed also in the COF substrate 410B that is bonded first, and the COF substrate 410B and the plate-shaped member 400 are bonded through the fixing opening 411. In other words, the COF substrate 410A having the fixing openings 411 may be configured to be bonded to both side faces of the plate-shaped member 400. In such a case, the time required for curing the adhesive agent 420 can be shortened, and thereby the manufacture efficiency can be improved. In addition, the attachment of the COF substrate 410B to the plate-shaped member 400 for the first time can be performed at high precision.

In addition, as shown in FIG. 3, between the lower end face of the plate-shaped member 400 and the lower end portion of the COF substrate 410 (the COF substrates 410A and 410B), a buffer member 430 that can be appropriately formed of Teflon (a registered trademark) or the like is disposed. In addition, the lower end portion of the COF substrate 410 and the lead electrode 90 are electrically connected by using conductive particles. In other words, by pressing the plate-shaped member 400 down, the COF substrate 410 is pressed to the lead electrode 90 side through the lower end face thereof. Accordingly, predetermined electrical connection between the COF substrate 410 and the lead electrode 90 is made by smashing the conductive particles. At this moment, the buffer member 430 serves to allow the pressure on the COF substrate 410 to be uniform. Here, it is preferable that the lower end face of the plate-shaped member 400 that is brought into contact with the lower end face of the plate-shaped member 400, the lower end portion of the COF substrate 410, or the buffer member 430 is configured to have surface precision within five times the particle diameter of the conductive particle. The reason is that, in such a case, through existence of the buffer member 430 and the lower end portion of the COF substrate 410, pressure applied to the conductive particles can be uniform, and whereby excellent electrical connection can be acquired by smashing the conductive particles.

In addition, it is preferable that the plate-shaped member 400 has such thermal conductivity that allows the plate-shaped member 400 to dissipate heat for having the temperature of the driving circuit 200 to be lower than the junction temperature even for a case where the ink jet recording head is used at the maximum warranty temperature. In such a case, even when the driving circuit 200 operates under the most severe load condition, sufficient heat dissipation is exhibited, and accordingly, stable driving of the driving circuit 200 for a long time can be achieved. Accordingly, the plate-shaped member 400 according to this embodiment is formed of SUS as a material thereof. In such a case, the plate-shaped member 400 allows heat generated by the driving circuit 200 to be absorbed in ink circulating the inside of the driving circuit 200 through the flow path forming substrate 10. As a result, the heat generated by the driving circuit 200 can be dissipated effectively. Similar effects can be acquired by configuring a distance between the surface of the flow path forming substrate 10 and the driving circuit 200 to be sufficiently short even for a case where a metal material such as SUS is not used. In other words, the distance between the driving circuit 200 and the flow path forming substrate 10 may be a distance in which heat is dissipated such that the temperature of the driving circuit 200 is lower than the junction temperature even for a case where the ink jet recording head I is used at the maximum warranty temperature.

In addition, it is preferable that the plate-shaped member 400 is formed of a material that has an linear expansion coefficient equivalent to that of a head case 110 that is a holding member to be described later in detail. For example, a stainless steel, silicon, or the like may be used as the material of the plate-shaped member 400.

In addition, as shown in FIG. 3, on the protection substrate 30, a compliance substrate 40 that is formed of a sealing film 41 and a fixed plate 42 is bonded. Here, the sealing film 41 is formed of a material having low rigidity and flexibility (for example, a polyphenylene sulfide (PPS) film). One side of the reservoir part 31 is sealed by the sealing film 41. In addition, the fixed plate 42 is formed of a hard material (for example, stainless steel (SUS) or the like) such as metal. An area of the fixed plate 42 that faces the reservoir 100 becomes an opening portion 43 acquired by completely eliminating a portion of the fixed plate 42 in the thickness direction, and accordingly, one side of the reservoir 100 is sealed only by the sealing film 41 having flexibility.

In addition, on the compliance substrate 40, the head case 110 as a holding member is disposed. In the head case 110, an ink introduction path 111 that is communicated with the ink introduction opening 44 and supplies ink to the reservoir 100 from an ink storing unit such as a cartridge is disposed. In addition, in an area of the head case 110 that faces the opening portion 43, a concave part 112 is formed such that bending deformation of the opening portion 43 is made appropriately. In addition, in the head case 110, a wiring member holding hole 113 that is communicated with the through hole 33 that is formed in the protection substrate 30 is disposed. The wiring member passes the inside of the wiring member holding hole 113 so as to be connected to the lead electrode 90. The wiring member that passes through the wiring member holding hole 113 of the head case 110 is bonded to the head case 110 through the adhesive agent 120.

As a material of the head case 110, for example, a metal material such as stainless steel may be used.

Here, in the COF substrate 410, as shown in FIGS. 4A and 4B, in an area of the head case 110 that faces the inner face of the wiring member holding hole 113, a holding opening 412 acquired by perforating the COF substrate 410 in the thickness direction is disposed. The plate-shaped member 400 is bonded to the head case 110 through the holding opening 412 formed in the COF substrate 410, through the adhesive agent 120. In other words, the plate-shaped member 400 of the wiring member and the head case 110 are directly bonded through the adhesive agent 120 disposed on the inside of the holding opening 412. In addition, in this embodiment, one holding opening 412 is disposed in the center portion of the wiring member holding hole 113 in the arrangement direction of the lead electrode 90 located on the lower end portion side of the COF substrate 410. In addition, in this embodiment, the fixing openings 411 are disposed at a same height as that of the holding opening 412, so that the fixing openings 411 are located on both end portion sides in the arrangement direction of the lead electrode 90 and serves as the holding opening 412. In other words, by bonding the adhesive agent 420 that bonds the plate-shaped member 400 and the COF substrate 410 and the head case 110 through the adhesive agent 120, the plate-shaped member 400 and the head case 110 are directly bonded through two adhesive agents 420 and 120, also in an area of the fixing opening 411.

In addition, the adhesive agent 120 that bonds the plate-shaped member 400 and the head case 110, on the periphery of the holding opening 412, fills between the plate-shaped member 400 and the COF substrate 410. Accordingly, the adhesive agent 120 serves as an adhesive agent that bonds the plate-shaped member 400 and the COF substrate 410, as well. In other words, the holding opening 412 is not used when the above-described COF substrate 410A is bonded to the plate-shaped member 400. However, the holding opening 412 serves as the fixing opening 411 used for bonding the plate-shaped member 400 and the COF substrate 410A when the head case 110 and the plate-shaped member 400 are bonded.

As described above, by directly bonding the plate-shaped member 400 and the head case 110 not through the COF substrate 410, the plate-shaped member 400 can be held in the head case 110 assuredly. In other words, by bonding the head case 110 and the plate-shaped member 400 as rigid bodies, a state in which the COF substrate 410 and the lead electrode 90 are connected assuredly can be maintained. Accordingly, any inconvenience of separation of connection between the COF substrate 410 and the lead electrode 90 so as to be disconnected or the like can be prevented. In addition, the head case 110 and the plate-shaped member 400 are formed of materials having an equivalent linear expansion coefficient, that is, stainless steel in this embodiment. Accordingly, when the ink jet recording head I is expanded or contracted due to heat, a bending state or destruction due to a difference of the linear expansion coefficients of the head case 110 and the plate-shaped member 400 can be prevented. When the head case 110 and the plate-shaped member 400 are formed of materials having different linear expansion coefficients, the plate-shaped member 400 presses the flow path forming substrate 10, and whereby a crack may be generated in the flow path forming substrate 10. In addition, it is preferable that the head case 110 and the plate-shaped member 400 are formed of materials having an approximately same linear expansion coefficient as that of the protection substrate 30 to which these members are fixed.

In addition, in this embodiment, the head case 110 and the plate-shaped member 400 are bonded through the adhesive agent 120 in the area (including an area in which the fixing opening 411 is disposed) in which the holding opening 412 of the COF substrate 410 is disposed. Additionally, the COF substrate 410 and the head case 110 may be configured to be bonded together. In addition, a space between the wiring member and the through hole 33 of the protection substrate 30 and the inside of the wiring member holding hole 113 may be molded with a molding material. In addition, by filling up a space between the wiring member and the protection substrate 30 and the head case 110 with gel formed of a heat-dissipating material of low viscosity that is not solidified, the heat dissipation of the driving circuit 200 and the plate-shaped member 400 can be improved further.

In addition, according to this embodiment, the driving circuits 200 of the COF substrates 410A and 410B are disposed on the outside of the head case 110. In other words, the head case 110 and the plate-shaped member 400 are bonded through the adhesive agent 120 on the lower side relative to the driving circuits 200 in the figure. As described above, by disposing the driving circuits 200 outside the head case 110, heat dissipation of the driving circuits 200 can be promoted.

As above, in the above described ink jet recording head, ink is introduced from an ink introduction port connected to an external ink storing unit not shown in the figure, and the inside thereof fills the reservoir 100 up to the nozzle opening 21. Then, by applying a voltage between the lower electrode film 60 and the upper electrode film 80 corresponding to each pressure generating chamber 12 in accordance with a recording signal transmitted from the driving circuit 200, the elastic film 50, the insulation film 55, and the lower electrode film 60, and the piezoelectric body layer 70 are deformed to be bent. Accordingly, the pressure of the inside of each pressure generating chamber 12 is increased, and whereby ink droplets are discharged from the nozzle opening 21.

In addition, according to this embodiment, the driving circuit 200 and the lead electrode 90 of the piezoelectric element 300 are connected through the COF substrate 410 on which the driving circuit 200 is mounted. Accordingly, the manufacturing process can be performed in an easy manner, compared to a case according to the wire bonding method. In addition, the lower end portion of the COF substrate 410 is connected the lead electrode 90 and can be erected approximately vertically, miniaturization of the ink jet recording head can be implemented without increasing the size thereof. In addition, the COF substrate 410 is directly connected to the lead electrode 90. Thus, even when the piezoelectric elements 300 are disposed at high density, high density can be achieved in an easy manner without incurring any bad connection between the lead electrode 90 and the COF substrate 410. In addition, since the driving circuit 200 is bonded to the side face side of the plate-shaped member 400 through the COF substrate 410, heat generated by the driving circuit 200 can be dissipated well.

Other Embodiments

As above, an embodiment of the invention has been described. However, the basic structure of an embodiment of the invention is not limited thereto. For example, in the above-described Embodiment 1, although the COF substrates 410 (410A and 410B) are disposed on both side faces of the plate-shaped member 400, however, two or more COF substrates 410 may be disposed on each side face.

In addition, although in the above-described Embodiment 1, one COF substrate 410 (410A or 410B) is disposed on each of both side faces of the plate-shaped member 400, the invention is not limited thereto. For example, the COF substrate 410 may be disposed on only one side face of the plate-shaped member 400. Alternatively, as the COF substrates 410 of both side faces, a continuous one printed substrate may be used. However, as in the above-described Embodiment 1, when a total of two COF substrates 410 (410A and 410B) including one COF substrate 410 for each of both the side faces of the plate-shaped member 400 are disposed, the positions cannot be determined easily. Thus, in such a case, by fixing the COF substrate 410A with the adhesive agent by using the fixing opening 411 of the COF substrate 410A, the advantage that the determination of the positions can be performed in an easy manner at high precision can be acquired more assuredly.

In addition, in the above-described Embodiment 1, although each fixing opening 411 is configured as an independent opening, the invention is not limited thereto. For example, the fixing opening 411 may be disposed as notch portions on both side faces in the arrangement direction of the lead electrode 90 of the COF substrate 410.

In addition, in the above-described Embodiment 1, although the plate-shaped member 400 and the head case 110 are directly bonded through the fixing openings 411 located on the both end portion sides in the arrangement direction of the lead electrode 90 of the COF substrate 410, the invention is not limited thereto. Thus, holding openings 412 other than the fixing openings 411 may be disposed further on both end portion sides of the COF substrate 410. In addition, the holding openings, for example, may be disposed as notch portions on both side faces in the arrangement direction of the lead electrode 90 of the COF substrate 410. In addition, it is apparent that the COF substrate 410 may be configured to be bonded to the plate-shaped member 400 in the periphery portion thereof.

In addition, in the above-described Embodiment 1, although two rows in which the pressure generating chambers 12 are arranged are disposed in the flow path forming substrate 10, however, the number of the rows is not particularly limited. Thus, the number of the rows may be one or three or more. When a plurality of the rows is disposed, it is preferable that at least two rows of one set are disposed to face each other.

In addition, in the above-described Embodiment 1, although the plate-shaped member 400 and the COF substrates 410A and 410B are bonded through the adhesive agent 420, however, the invention is not limited thereto. For example, any one of or both of the COF substrate 410A and the COF substrate 410B may be bonded to the plate-shaped member 400 by using a double-sided tape. Here, in order to attach the COF substrates 410A and 410B to the plate-shaped member 400 with double-sided tapes, it is preferable that bending angles of the end portions of the COF substrates 410A and 410B that are connected to the lead electrode 90 are configured to be larger than 90 degrees. Accordingly, even when the double-sided tapes are attached to both sides of the plate-shaped member 400 in advance, the COF substrates 410A and 410B are not bonded to the plate-shaped member 400 by the double-sided tapes before alignment for the COF substrates 410A and 410B is performed. Accordingly, even when the COF substrates 410A and 410B are bonded to the plate-shaped member 400 by using the double-sided tapes, alignment for the COF substrate 410A and the COF substrate 410B can be performed. In addition, after alignment for the COF substrate 410A and the COF substrate 410B are performed, by pressing the COF substrates 410A and 410B to the plate-shaped member 400 side, the COF substrates 410A and 410B and the plate-shaped member 400 can be bonded by using the double-sided tapes without incurring any positional deviation between the COF substrate 410A and the COF substrate 410B.

In addition, when the plate-shaped member 400 according to the above-described Embodiment 1 is formed of a conductive material, the plate-shaped member 400 may be configured to be grounded. As described above, by grounding the plate-shaped member 400, a noise that is generated in the driving circuits 200 and the like can be shielded, and accordingly, disturbance of the driving signal or the like due to the noise can be suppressed. In addition, by grounding the plate-shaped member 400, generation of noises due to a floating metal can be reduced at the time of movement of the ink jet recording head I.

In addition, when the plate-shaped member 400 and the head case 110 are formed of conductive materials, the plate-shaped member 400 and the head case 110 can be in a conductive state by using a conductive adhesive agent as the adhesive agent 120 that bonds the head case 110 and the plate-shaped member 400. Since the plate-shaped member 400 and the head case 110 are in a conductive state, both of them are grounded by grounding any one of them. Accordingly, a wiring or a process for grounding can be decreased. In addition, by grounding the plate-shaped member 400 and the head case 110, noises generated by the driving circuit 200 or the like can be shielded. In addition, by grounding the plate-shaped member 400 and the head case 110, generation of noises due to floating metal can be reduced. The floating metal described here represents a conductive member that configures the ink jet recording head I and is not grounded. In addition, grounding of the head case 110 and the plate-shaped member 400, for example, may be implemented through a ground wiring of the COF substrates 410A and 410B.

In addition, in the above-described Embodiment 1, although an actuator device having a thin-film type piezoelectric element 300 has been described as the pressure generating element that generates a pressure change in the pressure generating chamber 12, however, the invention is not limited thereto. For example, an actuator device of a thick film type that is formed by using a method of attaching a green sheet or the like, an actuator device of a vertical-vibration type that laminates a piezoelectric material and an electrode forming material alternately and expands or contracts the materials in the axis direction, or the like may be used. In addition, a device in which a heating element is disposed inside the pressure generating chamber as the pressure generating element and ink droplets are discharged from a nozzle opening due to bubbles that are generated by heat generation of the heating element, so-called an electrostatic actuator that generates static electricity between a vibration plate and an electrode and discharges ink droplets from a nozzle opening by deforming the vibration plate based on an electrostatic force, or the like may be used.

Figure 7:
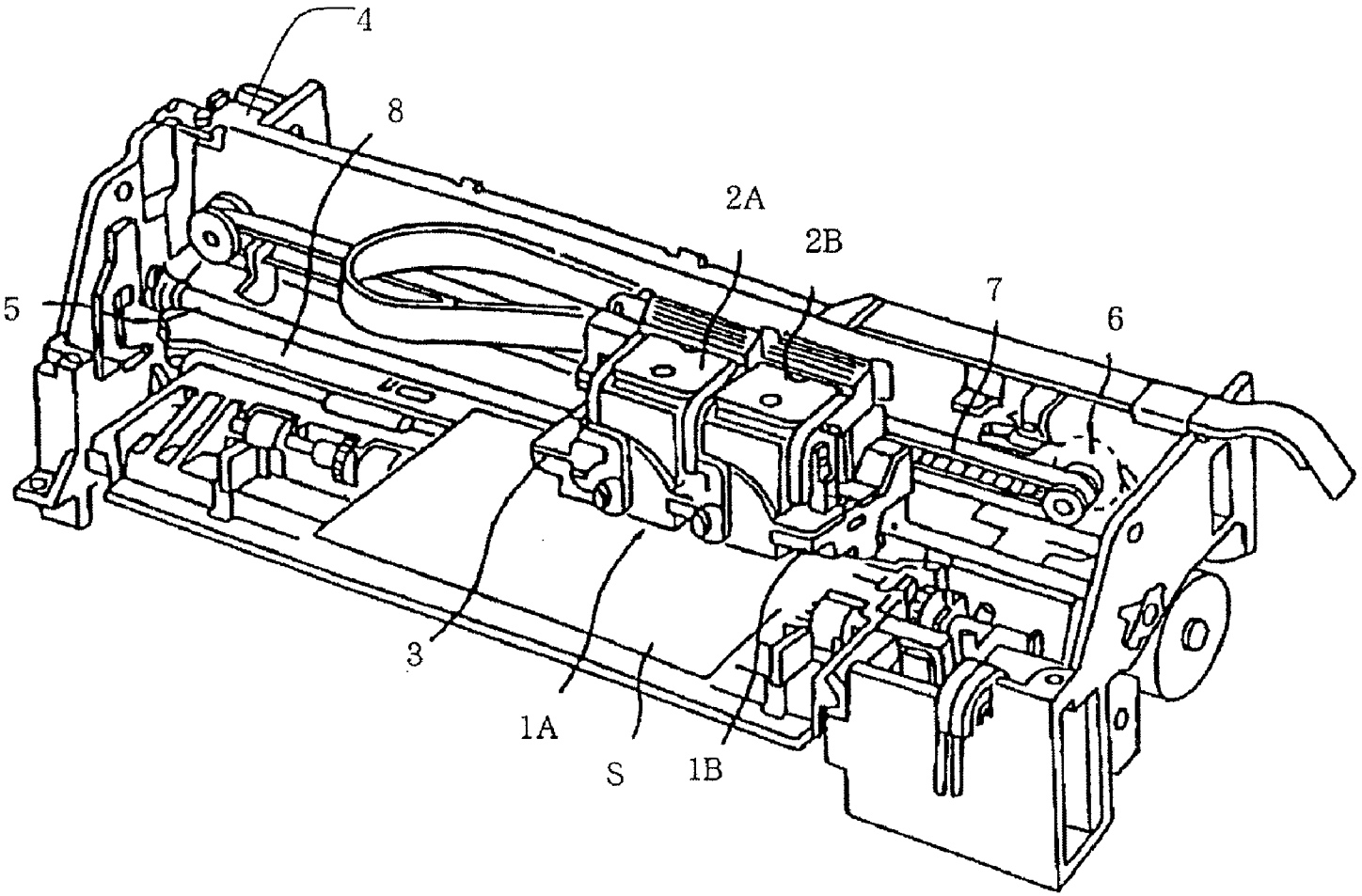
FIG. 7 is a schematic diagram showing an ink jet recording device according to an embodiment of the invention.

In addition, the ink jet recording head according to the above-described embodiment configures a part of a record head unit that includes an ink flowing path communicated with an ink cartridge or the like and is mounted on the ink jet recording device. FIG. 7 is a schematic diagram showing an example of the ink jet recording device. As shown in the figure, record head units 1A and 1B having the ink jet recording head I according to the above-described embodiment are disposed such that cartridges 2A and 2B that configure the ink supplying unit are disposed to be detachably attached thereto. In addition, a carriage 3 on which the record head units 1A and 1B are mounted is disposed to a carriage shaft 5, which is installed to a device main body 4, so as to be movable in the shaft direction. These record head units 1A and 1B, for example, are configured to discharge a black ink composition and a color ink composition.

As a driving force of the driving motor 6 is transferred to the carriage 3 through a plurality of gears and a timing belt 7 that are not shown in the figure, the carriage 3 on which the record head units 1A and 1B are mounted moves along the carriage shaft 5. On the other hand, in the device main body 4, a platen 8 is disposed along the carriage shaft 5, and a recording sheet S as a recording medium such as a paper sheet that is fed by a paper feed roller not shown in the figure or the like is wound around the platen 8 so as to be transported.

In addition, in the above-described embodiment, the ink jet recording head as an example of a liquid injecting head and the ink jet recording device as an example of a liquid injecting device have been described. However, the invention is for the overall liquid injecting heads and the overall liquid injecting devices in a broad meaning. Thus, the invention may be applied to a liquid injecting head or the liquid injecting device that injects liquid other than ink, as well. As liquid injecting heads other than the above-described embodiment, for example, there are various record heads that are used for an image recording apparatus such as a printer, a color material injecting head that is used for manufacturing a color filter of a liquid crystal display or the like, an organic EL display, an electrode material injecting head that is used for forming an electrode of an FED (field emission display) or the like, and a bioorganic material injecting head that is used for manufacturing a bio chip. In addition, the invention may be applied to a liquid injecting device having the above-described liquid injecting head.

In addition, in such a liquid injecting device, the head case 110 and the plate-shaped member 400 may be grounded by connecting a ground part that is grounded by being connected to an earth line or the like and the head case 110 and the plate-shaped member 400 of the liquid injecting head.

What is claimed is:

1. A liquid injecting head comprising:

a flow path forming substrate in which a pressure generating chamber communicated with a nozzle opening that injects liquid is formed;

a pressure generating element that is formed so as to apply pressure to the pressure generating chamber for injecting the liquid;

a lead electrode that is connected to the pressure generating element;

a wiring substrate having flexibility that is connected to the lead electrode;

a support member that is bonded to the wiring substrate; and a fixing opening formed by the wiring substrate in the thickness direction is disposed, and the wiring substrate and the support member are bonded together through an adhesive agent disposed inside the fixing opening.

2. The liquid injecting head according to claim 1, a plurality of the fixing openings is disposed at a regular distance in an area facing the support member toward an arrangement direction of the lead electrode.

3. The liquid injecting head according to claim 1, a row, in which the pressure generating element is arranged, is aligned to be built, the support member is disposed in the direction of the arrangement, the wiring substrate is bonded to both side faces of the support member, and the fixing openings of the wiring substrate are disposed in positions facing the both side faces of the support member.

4. The liquid injecting head according to claim 1, the adhesive agent that bonds the wiring substrate and the support member is formed of an ultraviolet curing-type adhesive agent.

5. The liquid injecting head according to claim 1, further comprising a holding member that is bonded to the support member through an adhesive agent.

6. The liquid injecting head according to claim 5, the support member is formed of a conductive material, and the support member is grounded.

7. The liquid injecting head according to claim 5, the support member and the holding member are formed of conductive materials, the adhesive agent that bonds the support member and the holding member is formed of a conductive adhesive agent, and the support member and the holding member are in a conductive state through the conductive adhesive agent.

8. The liquid injecting head according to claim 5, the support member and the holding member are formed of materials having equivalent linear expansion coefficients.

9. The liquid injecting head according to claim 5, a holding opening formed by perforating the wiring substrate in the thickness direction is disposed, and the support member and the holding member are bonded through the holding opening by using the adhesive agent.

10. The liquid injecting head according to claim 9, the holding opening that bonds the support member and the holding member is disposed in the wiring substrate and is the fixing opening that bonds the wiring member and the support member.

11. The liquid injecting head according to claim 5, the support member and the holding member are bonded in a plurality of positions.

12. The liquid injecting head according to claim 5, a wiring member holding hole, through which the support member and the wiring substrate pass, formed by perforating the holding member in the thickness direction is disposed, and an inner face of the wiring member holding hole and the support member are bonded through an adhesive agent.

13. The liquid injecting head according to claim 1, the wiring substrate and the lead electrode are electrically connected with conductive particles.

14. The liquid injecting head according to claim 1, a buffer member is disposed in a lower end face of the support member.

15. A liquid injecting device comprising the liquid injecting head according to claim 1.

16. The liquid injecting device according to claim 15, further comprising a ground part that grounds the support member.

17. A method of manufacturing a liquid injecting head that includes:

a flow path forming substrate in which a pressure generating chamber communicated with a nozzle opening that injects liquid is formed;

a pressure generating element that is formed so as to apply pressure to the pressure generating chamber for injecting the liquid;

a lead electrode that is connected to the pressure generating element;

a wiring substrate having flexibility that is connected to the lead electrode; and a support member that is bonded to the wiring substrate; and a fixing opening, which is formed by perforating the wiring substrate in the thickness direction, is disposed on at least a side face of the wiring substrate that is located on the lower end part side, the method comprising:

bonding the wiring substrate on one side of the support member;

disposing the wiring substrate on the other side of the support member so as to determine a position of one side of the wiring substrate with respect to the other side of the wiring substrate; and bonding the wiring substrate and the support member by using an adhesive agent of the fixing opening that is formed in the wiring substrate that is disposed on the other side of the support member.

* * * * *